US007858863B2

(12) United States Patent
Osuga

(10) Patent No.: US 7,858,863 B2
(45) Date of Patent: Dec. 28, 2010

(54) ELECTRONIC MUSICAL INSTRUMENT KEYBOARD APPARATUS

(75) Inventor: Ichiro Osuga, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 422 days.

(21) Appl. No.: 12/125,349

(22) Filed: May 22, 2008

(65) Prior Publication Data

US 2008/0295671 A1 Dec. 4, 2008

(30) Foreign Application Priority Data

May 28, 2007 (JP) ..... 2007-140369

(51) Int. Cl.
*G10C 3/12* (2006.01)
*G10H 1/32* (2006.01)
*G10H 3/00* (2006.01)

(52) U.S. Cl. ..... 84/423 R; 84/744; 84/433

(58) Field of Classification Search ..... 84/719, 84/723, 725, 726, 744, 18, 20, 25, 236, 423 R, 84/433
See application file for complete search history.

(56) References Cited

U.S. PATENT DOCUMENTS 4,512,234 A * 4/1985 Kumano ..... 84/433
4,602,549 A * 7/1986 Kumano ..... 84/433
4,901,614 A * 2/1990 Kumano et al. ..... 84/719
5,574,241 A * 11/1996 Kumano et al. ..... 84/439
5,796,023 A * 8/1998 Kumano et al. ..... 84/433
5,834,668 A * 11/1998 Kumano et al. ..... 84/423 R
5,932,825 A * 8/1999 Kumano et al. ..... 84/423 R
6,995,308 B2 * 2/2006 Nishida et al. ..... 84/439
7,141,729 B2 * 11/2006 Uno et al. ..... 84/236
7,332,663 B2 * 2/2008 Nishida ..... 84/423 R
7,365,259 B2 * 4/2008 Nishida ..... 84/423 R
7,465,863 B2 * 12/2008 Nishida ..... 84/423 R
7,576,273 B2 * 8/2009 Uno et al. ..... 84/236
7,582,821 B2 * 9/2009 Watanabe ..... 84/423 R
7,586,030 B2 * 9/2009 Nishida ..... 84/423 R
7,696,424 B2 * 4/2010 Osuga et al. ..... 84/423 R
7,709,718 B2 * 5/2010 Osuga ..... 84/423 R
7,732,686 B2 * 6/2010 Yamaguchi ..... 84/236
7,750,222 B2 * 7/2010 Osuga ..... 84/423 R
7,767,892 B2 * 8/2010 Osuga ..... 84/423 R
2001/0037723 A1 * 11/2001 Nishida et al. ..... 84/744

(Continued)

FOREIGN PATENT DOCUMENTS

JP 3060930 7/1997

*Primary Examiner*—Elvin G Enad
*Assistant Examiner*—Andrew R Millikin
(74) *Attorney, Agent, or Firm*—Morrison & Foerster LLP

(57) ABSTRACT

Mass body unit includes a base section, an elongated member, and a mass concentrating section. The elongated member is formed by a thin sheet metal plate being bent, along its length, into a hollow cross-sectional shape such that an opening portion is defined between left and right longitudinal edges. In a section of the elongated member near a rear end of the member, the left and right longitudinal edges extend in parallel to define an outer wall portion of a U cross-sectional shape. In a section of the elongated member near a boundary position adjacent to the rear end of the member, the opening portion between the left and right longitudinal edges gradually decreases in width. Further, in a section from the boundary position to a front end, the elongated member has a hollow circular cross-sectional shape with the opening portion closed.

14 Claims, 5 Drawing Sheets

U.S. PATENT DOCUMENTS

2007/0017341 A1* 1/2007 Nishida ..... 84/423 R
2007/0017343 A1* 1/2007 Nishida ..... 84/423 R
2007/0068360 A1* 3/2007 Uno et al. ..... 84/236
2008/0098874 A1* 5/2008 Osuga et al. ..... 84/433
2008/0163741 A1* 7/2008 Ishihara et al. ..... 84/435
2008/0236362 A1* 10/2008 Osuga ..... 84/423 R
2008/0257132 A1* 10/2008 Kato ..... 84/433
2008/0276789 A1* 11/2008 Shimizu ..... 84/433
2008/0295671 A1* 12/2008 Osuga ..... 84/600
2008/0307944 A1* 12/2008 Watanabe ..... 84/433
2009/0007756 A1* 1/2009 Osuga ..... 84/423 R
2009/0078107 A1* 3/2009 Osuga ..... 84/423 R

* cited by examiner

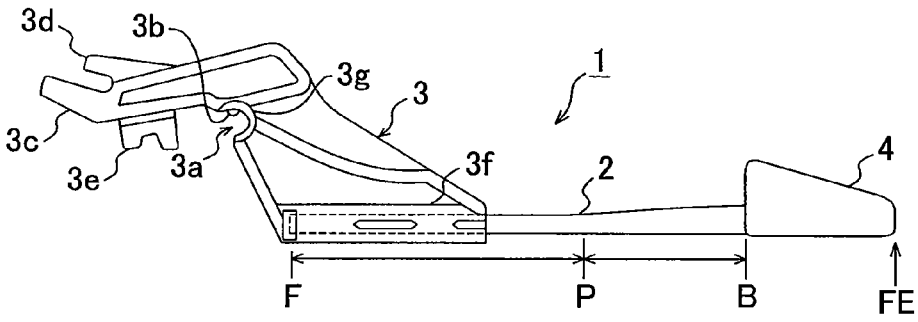
FIG.1A
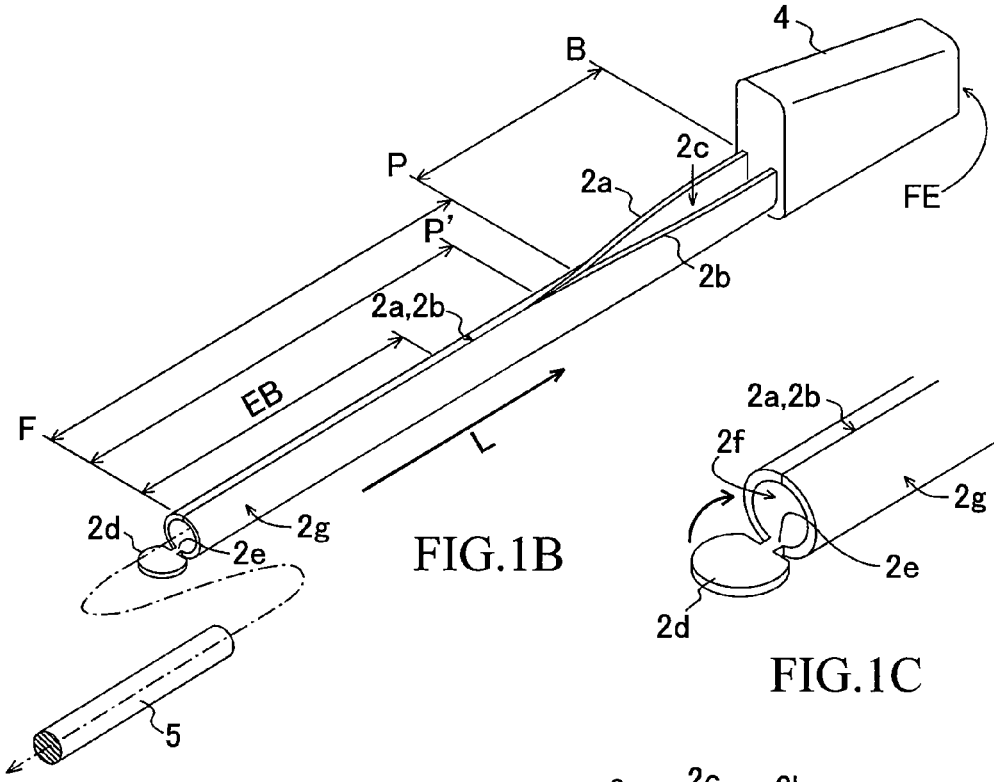
FIG.1B
FIG.1C
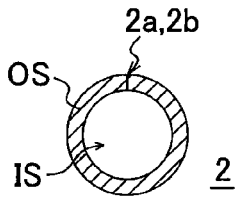
FIG.1D
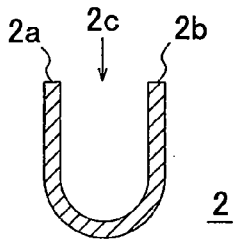
FIG.1E

ELECTRONIC MUSICAL INSTRUMENT KEYBOARD APPARATUS

BACKGROUND

The present invention relates to electronic musical instrument keyboard apparatus equipped with mass body (or hammer) units.

Keyboard apparatus of electronic musical instruments have been known from, for example, Japanese Patent No. 3,060,930, in which keys and mass body units corresponding to the keys are supported on a frame and each of the mass body units is pivotable in response to operation of the corresponding key.

FIGS. 8A and 8B are views, with parts taken away, showing an inner construction and mass body units of a conventionally-known keyboard apparatus of the above-mentioned type. In FIG. 8A, a plurality of white and black keys 51 and 52 are disposed in parallel to one another, and each of the white and black keys 51 and 52 has at its rear end portion a pivot point portion 51*a* or 52*a* supported by a key support section 53*a* of the frame.

Each of the white keys 51*n* has a force transmitting portion 51*b* projecting downward from its front lower surface, and the force transmitting portion 51*b* has a distal-end engaging portion. Resilient member 54 is secured to the lower surface of the engaging portion. When depressed, the white key 51 is guided vertically by a key guide 53*c* projecting upward from a front horizontal surface portion 53*b* of the frame.

Although not shown in the figures, each of the black keys 52 has a force transmitting portion projecting downward from its front lower surface portion and then bending forward and having its distal-end engaging portion engaging with the corresponding mass body unit, and a resilient member is secured to the lower surface of the engaging portion. When depressed, the black key 52 is guided vertically along a key guide projecting from a middle horizontal surface portion 53*d*; the key guide of the black key 52 is identical in construction to the key guide 53*e* of a black key shown as removed in the figure.

Reference numeral 55 indicates the mass body unit, and the mass body units 55 of generally the same construction are provided below and in one-to-one corresponding relation to the white and black keys 51 and 52. Leaf spring 56 is disposed through a window 53*f* between each of the white key 51 and the corresponding mass body unit 55; more specifically, it is connected at its one end to the interior of the white key 51, passed through the window 53*f* formed through the thickness of the frame and connected at the other end to the mass body unit 55. Elongated slanting plate 53*g*, extending from a lower front end position of the frame 53 rearward obliquely upward as viewed in a front-rear direction of the keyboard apparatus, lies along a length over which the keys 51 and 52 are arranged (key-arranged direction). Mass body unit support section 53*h* in the form of a substantial cylindrical column is provided on and along the upper end of the elongated slanting plate 53*g*, and each of the mass body units 55 is pivotably supported on the support section 53*h*. Printed circuit board 57 is provided under the slanting plate 53*g*, and through-holes 53*i* are formed in the slanting plate 53*g*. Two rows of key switches 58, two per through-hole 53*i*, are provided on the printed circuit board 57.

As shown in FIG. 8B, the mass body unit 55 includes a resin-made base section 3 and an elongated member 59. The base section 3 has a pivot point portion 3*a* of a semicircular sectional shape kept in fitting engagement with the mass body unit support section 53*h* of the frame 53. The pivot point portion 3*a* has a projection 3*b* engaged in a groove formed in the mass body unit support section 53*h*.

The pivot point portion 3*a* is bifurcated at its front end into main and auxiliary driven portions 3*c* and 3*d*, and these main and auxiliary driven portions 3*c* and 3*d* engage with the engaging portion, provided at the distal end of the force transmitting portion 51*b* of the white key 51, via the resilient member 54. Each of the black keys 52 engages with the corresponding mass body unit 55 in a similar manner to the white key 51.

Downwardly-projecting switch driving portion 3*e* is provided below and between the auxiliary driven portion 3*d* and the pivot point portion 3*a*, and this switch driving portion 3*e* sequentially depresses the two key switches 58 with a given time difference as a front upper surface area of any one of the white and black keys 51 and 52 is depressed.

The base section 3 and the elongated member 59 are interconnected integrally via a connecting portion 3*f* located below and rearwardly of the pivot point portion 3*a*. The spring 56 has an engaging portion 3*g* located on the outer periphery of the pivot point portion 3*a*. The elongated member 59 is in the form of a metal rod of a circular cross-sectional shape extending along the length of the corresponding key and produces a great moment of inertia when it pivots. The elongated member 59 has, at its rear end remotest from the pivot point portion 3*a*, a bent extension portion 59*a* on which its mass concentrates. As a human player depresses one of the white keys 51 with a finger in the example of FIG. 8A, the corresponding mass body unit 55 pivots, a reactive force corresponding to a moment of inertia of the elongated member 59 is given from the white key 51 to the player's finger. Then, once the human player releases the finger from the depressed white key 51, the mass body 55 pivots back to the original position.

Elongated lower-limit stopper (lower movement limiting member) 60 is disposed along the key-arranged direction beneath a rear end portion of the frame 53, while an elongated upper-limit stopper (upper movement limiting member) 61 is disposed along the key-arranged direction above the rear end of the frame 53. Generally, each of these elongated stoppers 60 and 61 is in the form of a felt belt and defines a lower- or upper-limit position in a pivoting range of the mass body unit 55 by a rear end lower surface of the elongated member 55 or upper surface of the bent extension portion 59*a* abutting against the felt belt. The black keys 52 and their respective mass body units operate similarly to the white keys 51 and their respective mass body units.

The functions of each of the mass body units 55 are not only to give a key-depressing finger a feeling of mass but also to achieve characteristics of the entire keyboard mechanism; for example, each of the mass body units 55 provides a "feeling of stop" by striking or abutting against the lower-limit or upper-limit stopper 60 or 61.

However, the length and rigidity of the mass body units 55, shapes of the portions (such as the rear end portions and bent extension portions 59*a*) of the elongated members 59) abutting against the lower-limit and upper-limit stoppers 60 and 61, etc. are subjected to various limitations in order to achieve a good feeling of stop.

Particularly, in a case where it is desired to not employ a metal rod of a circular cross-sectional shape as the elongated member 59 in order to reduce the weight of the electronic keyboard instrument, there is a need to minimize decrease in the rigidity of the elongated member 59. If the elongated member 59 has a small rigidity, the elongated member 59 would give a poor response (reactive force) because the elongated member 59 itself would be greatly distorted. Thus, it is conceivable to employ a pipe of a hollow circular cross-sectional shape as the elongated member 59. To form a bendable, thin sheet metal plate into such a pipe of a hollow circular cross-sectional shape using a mandrel, the sheet metal plate is bent arcuately along its length. However, if a long pipe is to be formed, there would arise various problems, such as the one that the mandrel can not be pulled out of the pipe or may break after the bending due to a great frictional force between the mandrel and the pipe.

SUMMARY OF THE INVENTION

In view of the foregoing, it is an object of the present invention to provide an improved electronic musical instrument keyboard apparatus which is equipped with mass body units each capable of giving a feeling of stop with a good reactive force despite a small weight of the mass body unit.

In order to accomplish the above-mentioned object, the present invention provides an improved electronic musical instrument keyboard apparatus, which comprises: a plurality of keys; a plurality of mass body units each pivotable in response to operation of a corresponding one of the keys; a frame supporting the plurality of keys and the plurality of mass body units; and a movement limiting member provided on the frame for limiting a pivotable range of each of the keys, and in which each of the mass body units includes an elongated member, the elongated member being formed, by a bendable sheet metal plate being bent along a longitudinal direction (i.e., along a length) thereof, to have a cross section with an opening portion.

The "bendable sheet metal plate" used herein is a thin, flat metal plate bendable by a processing machine, such as a shaping machine or bending machine. By using such a bendable, thin sheet metal plate to form the elongated member, the mass body unit employed in the present invention can be significantly reduced in weight and constructed with an increased efficiency as compared to the conventional counterparts where the elongated member is in the form of a metal rod of a solid, circular cross-sectional shape. Further, by the thin, flat metal plate being bent into the elongated member having the cross section with the opening portion, the mass body unit can have an increased moment of inertia of area, so that it can have a sufficient rigidity in a direction toward the opening portion. Further, the elongated member can also have a certain degree of rigidity in the left-right or width direction of the opening portion.

As an example, the elongated member has, in a longitudinal section thereof, a cross section with the opening portion closed. With the opening portion closed, the mass body unit can have a great moment of inertia of area and high rigidity in all peripheral directions. The rigidity of the elongated member can be even further increased if the opposed edges of the closed opening portion are joined together by welding or otherwise. In the case where the opening portion is closed over a longitudinal partial section of the elongated member, the thin, flat metal plate can be bent more easily than in a case where the opening portion is closed over the full length of the elongated member. In the present invention, the opening portion need not be completely closed; namely, a slight opening or gap may be provided between the left and right longitudinal edges defining the opening portion. Providing the above-mentioned longitudinal partial section close to the pivot point of the mass body unit can enhance the rigidity of a portion of the elongated member that tends to easily flex due to the proximity to the pivot point.

In a case where the base section of the mass body unit is made of synthetic resin and molded integrally with the elongated member, the above-mentioned longitudinal partial section is provided adjacent to the front end of the elongated member, and the base section is inserted into and integrated with part of the longitudinal partial section of the elongated member; in this case, the longitudinal partial section may be formed into a hollow circular cross-sectional shape.

As an example, the elongated member has, in a section thereof having the cross section with the opening portion, first and second partial structures each having a cross section with a bottom portion and the opening portion, the first and second partial structures being joined with each other via a single vertical side wall portion with respective ones of the opening portions vertically opposed to each other. The first and second partial structures can enhance the mechanical strength of the elongated member against undesired flexure as compared to a case where the elongated member has only one of the first and second partial structures. Because lower and upper surface portions of the elongated member each have a bottomed cross-sectional shape, parts of the bottoms of the lower and upper surface portions can be provided as abutting portions that strike or abut against the movement limiting members. As a consequence, the mass body unit can be significantly simplified in construction. In the case where parts of the bottoms of the lower and upper surface portions are provided as the abutting portions, the pivoting range of the mass body unit can be adjusted by only changing the height of the vertical side wall portion, so that designing of the mass body unit can be significantly facilitated. If the above-mentioned bottoms of the lower and upper surface portions are each formed into a semicircular or corner-rounded cross-sectional shape, the movement limiting members can have an increased durability.

As an example, the elongated member has, in a first section thereof that is a part of a section having the cross section with the opening portion, a first structure including a bottom portion and the opening portion with the opening portion oriented upward or downward. Further, the elongated member has, in a second section thereof that is another part of the section having the cross section with the opening portion, a first partial structure that is a longitudinal extension of the first structure and a second partial structure that has a cross section with a bottom portion and the opening portion, the first and second partial structures being joined with each other via a single vertical side wall portion with respective ones of the opening portions vertically opposed to each other.

Thus, the above-mentioned second section can be provided as the mass concentrating section. If the second section is disposed remotely from the pivot point of the mass body unit, the mass body unit can have a great moment of inertia without the mass of the elongated member being changed. In the second section, the first and second partial structures can enhance the mechanical strength of the elongated member against undesired flexure as compared to a case where the elongated member has only one of the first and second partial structures. Because lower and upper surface portions of the elongated member each have a bottomed cross section, parts of the bottoms of the lower and upper surface portions can be provided as abutting portions that strike the movement limiting member. As a consequence, the mass body unit can be significantly simplified in construction. In the case where at least parts of the bottoms of the lower and upper surface portions are provided as the abutting portions, the pivoting range of the mass body unit can be adjusted by only changing the height of the vertical side wall portion, so that designing of the mass body unit can be significantly facilitated. If the above-mentioned bottoms of the lower and upper surface portions are each formed into a semicircular or corner-rounded cross-sectional shape, the movement limiting member can have an increased durability.

As an example, at least one of a length, in the longitudinal direction, of the second section of the elongated member and a length, in the longitudinal direction, of the elongated member is varied in accordance with a tone pitch or key range of a key corresponding to the mass body unit having the elongated member so that a mass of inertia of the elongated member takes a value corresponding to the tone pitch or key range of the key corresponding to the mass body unit. Thus, even in the case where the thin sheet metal plate is used to form the elongated member, a plurality of the mass body units of different moments of inertia can be provided in parallel to one other, and hence the key touch scaling can be performed in a direction where the keys are arranged (i.e., in the key-arranged direction). The moment of inertia may be varied not only per key, but also per octave, key range or the like.

According to another aspect of the present invention, there is provided an improved electronic musical instrument keyboard apparatus, which comprises: a plurality of keys: a plurality of mass body units each pivotable about a pivot point portion in response to operation of a corresponding one of the keys; a frame supporting the plurality of keys and the plurality of mass body units; and a movement limiting member provided on the frame for limiting a pivotable range of each of the keys, and in which each of the mass body units includes an elongated member, the elongated member having an outer wall portion of a cross section defining a hollow interior portion, the elongated member having an elongated uniform-cross-sectional section where the cross section is uniform in the longitudinal direction, the elongated member having, in a region thereof adjacent to a free end of the elongated member and remote from the pivot point portion, an opening greater than an opening formed in the uniform-cross-sectional section.

With the uniform-cross-sectional section having the outer wall portion defining the hollow interior portion, the mass body unit employed in the present invention can be significantly reduced in weight as compared to the conventional counterparts where the elongated member is in the form of a metal rod of a solid, circular cross-sectional shape. If the uniform-cross-sectional section has no or slight opening, the elongated member can obtain a great moment of inertia and can have a high rigidity in all peripheral directions. Section of the elongated member adjacent to the free end of the member does not flex easily even if it has a greater opening than the uniform-cross-sectional section that has no or slight opening, and thus, this section adjacent to the free end can have a greater moment of inertia of area than an elongated member in the form of a flat plate. Consequently, it can have a sufficient rigidity in the direction toward the opening portion and a certain degree of rigidity in the left-right or width direction of the opening portion.

In the case where the base section of the mass body unit is made of synthetic resin and molded integrally with the elongated member, the above-mentioned uniform-cross-sectional section is provided adjacent to the front end, and the base section is inserted into and integrated with the uniform-cross-sectional section of the elongated member; in this case, the longitudinal partial section may be formed into a hollow circular cross-sectional shape.

The present invention arranged in the aforementioned manner can give a feeling of stop with a good reactive force despite the small weight of the mass body unit. Particularly, the present invention is suited for use in transportable electronic musical instruments of which weight minimization is often required.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which:

FIGS. 1A to 1E are views showing a mass body unit with an example of an elongated member employed in an electronic musical instrument keyboard apparatus according to a first embodiment of the present invention;

DETAILED DESCRIPTION

Figure 2A:
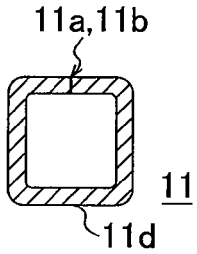
FIGS. 2A-2D are sectional views showing other specific examples of the elongated member which may be employed in the first embodiment of the present invention.

FIGS. 1A to 1E are views showing a mass body unit employed in a keyboard apparatus according to a first embodiment of the present invention.

As shown in FIG. 1A, the mass body unit 1 integrally includes a base section 3, an elongated member 2 and a mass concentrating section 4. The elongated member 2 has its front end F integrally formed with the base section 3, and the elongated member 2 has its rear end B integrally formed with the mass concentrating section 4. The mass body unit 1 pivots in response to depressing operation, by a human player, of a corresponding key, during which time the mass concentrating section 4 abuts against lower-limit and upper-limit stoppers similar to the stoppers 60 and 61 shown in FIG. 8; thus, the lower-limit and upper-limit stoppers will hereinafter be referred to as lower-limit and upper-limit stoppers 60 and 61.

Figure 8A:
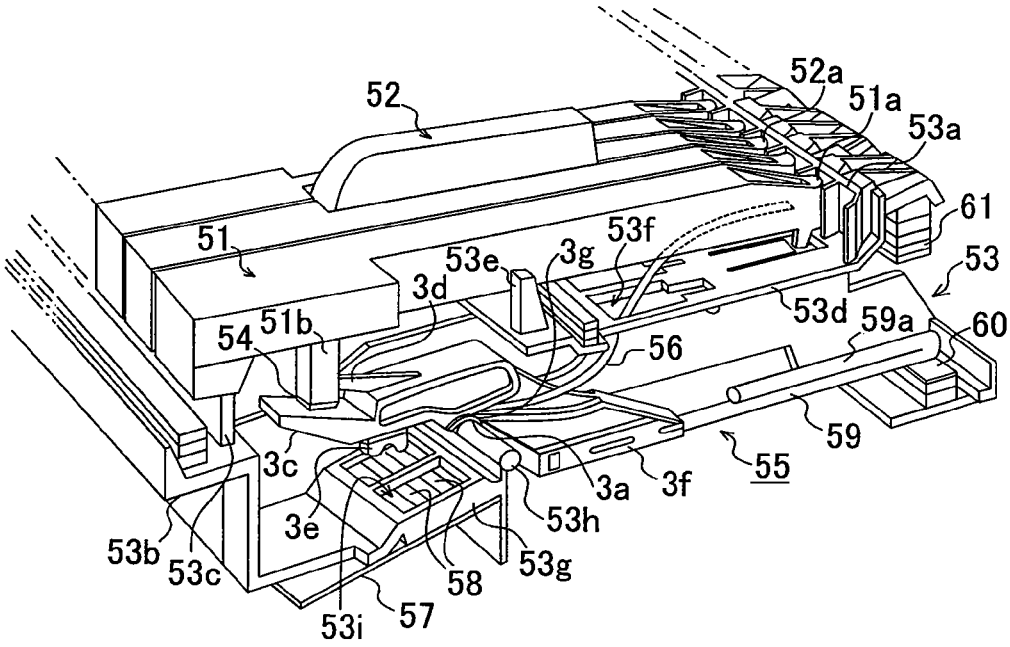
(PRIOR ART) FIG.8A
FIGS. 8A and 8B are views showing an inner construction of a conventionally-known electronic musical instrument keyboard apparatus and a mass body unit employed therein.
Figure 8B:
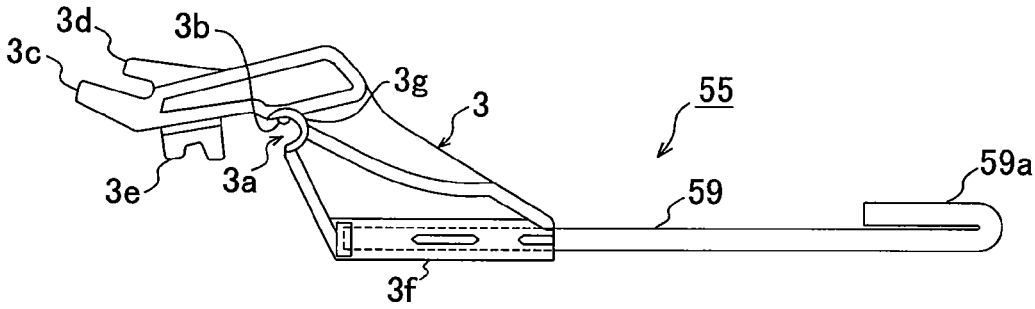
(PRIOR ART) FIG.8B

The base section 3 shown in FIG. 1 is similar in construction to the base section 3 explained above in relation to the conventionally-known keyboard apparatus of FIG. 8, but it only need have a pivot point portion 3*a* and main and auxiliary driven portions 3*c* and 3*d* similar to those of FIG. 8. In the instant embodiment, however, a switch driving portion 3*e* may be provided on the corresponding white key 51 or black key 52 rather than on the base section 3.

As shown in FIG. 1B, the elongated member 2 is formed of a rectangular thin sheet metal plate bendable by a bending machine. By the thin sheet metal plate being bent arcuately along its length (i.e., along its longitudinal direction), there is formed a substantially pipe-shaped portion between left and right longitudinal edges 2*a* and 2*b*. The substantially pipe-shaped portion is of a cross-sectional shape having an opening portion 2*c* between the left and right longitudinal edges 2*a* and 2*b* along the length of the elongated member 2. The terms "cross-sectional shape" or "cross section" are used herein to represent a section made by cutting the elongated member 2 at right angles to the length of the elongated member 2.

The elongated member 2 is formed by bending the rectangular thin sheet metal plate arcuately along the length about a mandrel 5 in the form of a rod of a circular cross-sectional shape. The elongated member 2 is further bent so that the left and right longitudinal edges 2*a* and 2*b* abut against each other over its longitudinal region between a boundary position P and the front end F of the elongated member 2. The thickness of the thin sheet metal plate only has to be, for example, 1 mm or less.

Thus, in a rear region adjacent to the rear end or free end FE of the elongated member 2 remote from the pivot point portion 3*a*, the elongated member 2 has an outer wall portion of a U cross-sectional shape with the left and right longitudinal edges 2*a* and 2*b* extending in parallel to each other. Further, in a region from the front end of the above-mentioned rear region of the elongated member 2 to the boundary position P and, the opening portion 2*c*, i.e. opening or gap between the left and right longitudinal edges 2*a* and 2*b*, gradually narrows from its greatest-width position to its completely closed position. Thus, the moment of inertia of area gradually varies, and the elongated member 2 would become difficult to bend in that region. Furthermore, in a region from the boundary position P to the front end F (F-P), the elongated member 2 has a closed bent cross-sectional shape (F-P) with the opening portion 2*c* closed; thus, a closed bent cross-sectional section (F-P) is provided.

Furthermore, in a front region from a boundary position P', located closer to the front end F than the boundary position P, to the front end, the elongated member 2 has a uniform closed circular cross-sectional shape with a hollow interior portion 2*f* defined by an outer peripheral wall portion 2*g*; thus, a uniform elongated section (F'-P') is provided.

In the closed bent cross-sectional section (F-P), the opening portion 2*c* need not necessarily be completely closed; namely, a slight opening may be formed between the left and right longitudinal edges 2*a* and 2*b*. By contrast, the uniform elongated section (F'-P') has no such gap or opening between the left and right longitudinal edges 2*a* and 2*b*; alternatively, there may be formed an extremely small opening between the left and right longitudinal edges 2*a* and 2*b*. In a region of the outer peripheral wall portion adjacent to the free end and remote from the pivot point portion 3*a*, the opening portion 2*c* is greater than the opening portion 2*c* (if any) of the uniform elongated section (F-P').

The closed bent cross-sectional section (F-P) extending from the front end F to the boundary position P is only a part of the elongated member 2. Thus, in the closed bent cross-sectional section (F-P), the thin sheet metal plate is pressed against the mandrel 5 over a length smaller than the total length of the elongated member 2 during the bending of the sheet metal plate. Consequently, the mandrel 5 can be pulled out easily after the bending.

Because a region of the elongated member 2 closer to the pivot point portion 3*a* is more easily flexible than the remaining region, it is preferable that the uniform elongated section (F'-P') and closed bent cross-sectional section (F-P) be provided in a region adjacent to the front end F and closer to the pivot point portion 3*a*.

In the illustrated example, the base section 3 of resin is outsert-molded. More specifically, the base section 3 is molded by pouring synthetic resin into a mold cavity with the front end F of the elongated member 2 inserted in the mold. Thus, a predetermined length, from the front end F, of the elongated member 2 is provided as an integrally-molded section (embedded part) EB embedded in and integrally molded (integrated) with the base section 3. This integrally-molded section is in the closed bent cross-sectional section (F-P) or just in the uniform elongated section (F'-P'). In the part of the elongated member 2 embedded in the base section 3, there is achieved an increased moment of inertia of area and hence a sufficient strength. In other words, the base section 3 is integrated with part of the section (F-P) or (F-P')

The rear end B, on the other hand, is integrated with the mass concentrating section 4 by being inserted into a hole formed previously in the mass concentrating section 4. Note that, to integrate the elongated member 2 with the base section 3 too, the front end F of the member 2 may be inserted into a hole formed previously in the base section 3.

FIG. 1C is a view showing in enlarged scale a portion of the elongated member 2 in the neighborhood of the front end F. Lid portion 2*d* of a disk shape is formed integrally with the front end F of the rectangular sheet metal plate having the left and right longitudinal edges 2*a* and 2*b*. In the illustrated example, the disk-shaped lid portion 2*d* is recessed so as to provide a small-width connecting portion 2*e* between the lid portion 2*d* and the front end F.

After the thin sheet metal plate being bent into the closed bent cross-sectional shape by use of the mandrel 5, the lid portion 2*d* is bent at the connecting portion 2*e* inwardly 90 degrees so that the front end F is closed with the lid portion 2*d*.

During the outsert-molding of the base section 3, the elongated member 2 is subjected to external molding pressure from all peripheral directions because the opening portion is closed in the integrated molded section EB of the member 2. As a consequence, the base section 3 can have a stable quality. Particularly, these sections are subjected to uniform molding pressure all the peripheral directions because of the hollow circular cross-sectional shape, the stable quality of the base section 3 can have be even further enhanced.

Furthermore, because the opening portion is closed in the integrated molded section of the elongated member 2, the synthetic resin in a molten state can be reliably prevented from flowing out of the integrated molded section and getting solidified, even if no particular measures are taken. Thus, flowing-out of the molten synthetic resin itself does not matter so much. However, because the flowing amount of the molten synthetic resin is not constant, there would arise variation in the mass and moment of inertia of the mass body unit 1 from one product (i.e., keyboard apparatus manufactured) to another. If the front end F is open, the molten synthetic resin may flow out into the closed cross section, despite the closed configuration, unless particular measures are taken.

This is why the lid portion 2*d* is provided as noted above. Namely, even if the front end F of the closed bent cross-sectional section (F-P) is inserted in the mold, the lid portion 2*d* can prevent the molten synthetic resin from flowing out into the hollow interior. If the lid portion 2*d* can prevent flowing-out of the molten synthetic resin, there may be a small gap in the lid portion 2*d*.

In place of the lid portion 2*d*, there may be provided a barrier wall portion in the interior of the elongated member 2 so as to keep constant the flowing-out amount of the molten synthetic resin.

With the rectangular thin sheet metal plate bent in the aforementioned manner, the left and right longitudinal edges 2*a* and 2*b* in an open cross-sectional section (P-B) of the elongated member 2 has a greater height than those in the closed bent cross-sectional section (F-P). However, if the rectangular thin sheet metal plate in its initial (i.e., unbent) state has a stepped shape such that a region of the sheet metal plate to be formed into the closed bent cross-sectional section (F-P) has a different dimension in the left-right direction than a region of the sheet metal plate to be formed into the open cross-sectional section (P-B), the height of the left and right longitudinal edges 2*a* and 2*b* in the open cross-sectional section (P-B) can be designed as desired. The opening portion 2*c* is shown as oriented vertically upward in the illustrated example; the elongated member 2, base section 3 and mass concentrating section 4 may be integrated in such a manner that the opening portion 2*c* is oriented vertically upward.

FIGS. 1D and 1E are views explanatory of the cross-sectional shape of the elongated member 2. As shown in FIG. 1D, the closed bent cross-sectional section (F-P) has a hollow circular cross-sectional shape IS defined by a circular outer wall portion OS. Because the hollow circular cross section can provide a great moment of inertia of area and section modulus even though the thin sheet metal plate itself has a small sectional area and has a small weight, the elongated member 2 can have a great bending rigidity and strength.

Although it is preferable that mutually-abutted portions of the left and right longitudinal edges 2*a* and 2*b* be integrally welded together, these left and right longitudinal edges 2*a* and 2*b* may be merely abutted against each other or slightly spaced from each other with an extremely small opening therebetween.

As shown in FIG. 1E, the outer wall portion of the open cross-sectional section (P-B), except for a transient section in the neighborhood of the boundary position P, has a U cross-sectional shape having two parallel leg portions extending vertically with the opening portion 2*c* located therebetween and a bottom portion of a semicircular cross section.

As compared to the conventional elongated members in the form of a metal rod of a generally solid, circular cross-sectional shape, such as the elongated member 59 shown in FIG. 8, the elongated member 2 employed in the instant embodiment can be significantly reduced in weight and can have an increased moment of inertia of area and sufficient rigidity.

The open cross-sectional section (P-B), made by bending the flat sheet metal plate into the cross-sectional shape having the opening portion 2*c*, can provide an increased moment of inertia of area in the vertical direction as compared to a single horizontally-disposed flat (i.e., unbent) sheet metal plate, so that it can secure a rigidity in a direction toward the opening portion 2*c*, i.e. in the pivoting direction of the mass body unit 1.

The open cross-sectional section (P-B) shown in FIG. 1E can provide an increased moment of inertia of area in the vertical direction as compared to the open cross-sectional section (P-B) shown in FIG. 1D because the outer wall portion has an increased height in the vertical direction, i.e. in the pivoting direction of the mass body unit 1. Further, the open cross-sectional section (P-B) shown in FIG. 1E can also secure an increased rigidity in the left-right or width direction of the opening portion 2*c* (i.e., key-arranged direction).

Particularly, with the rear end B integrated with the mass concentrating section 4 as shown in FIG. 1B, the open cross-sectional section (P-B) too can have a sufficient strength against undesired flexure in the left-right or width direction of the opening portion 2*c*.

The elongated member 2 of FIG. 1, made by bending the thin sheet metal plate, can have a great bending rigidity and bending strength, although light in weight, as long as it has a combination of the closed bent cross-section and open cross-section. Therefore, the elongated member 2 need not necessarily be of a hollow circular cross-sectional or U cross-sectional shape.

FIGS. 2A-2D are sectional views showing other examples of the elongated member 2 which can be also employed in the instant embodiment of the present invention.

Figure 2B:
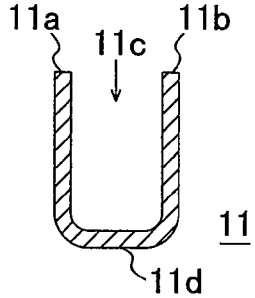

The example of the elongated member 11 shown in FIG. 2B is made by a thin sheet metal plate being bent, along the length about a mandrel of a rectangular cross-sectional shape, so that it has a U cross-sectional shape with rounded lower left and right bottom corners and with an upward oriented opening between the left and right longitudinal edges 11*a* and 11*b*. The left and right side surfaces (leg portions or vertical side wall portions) extend vertically upward in parallel to each other with the opening 11*c* therebetween.

The example of the elongated member 11 shown in FIG. 2A is made by the thin sheet metal plate being further bent, along the length about the mandrel of the rectangular cross-sectional shape, so that it has a hollow rectangular cross-sectional shape with the left and right longitudinal edges 11*a* and 11*b* abutted against each other with no gap or opening therebetween and with four corners rounded.

Although not specifically shown, the thin sheet metal plate may be bent along its length about a mandrel of a rectangular cross-sectional shape. With such a mandrel, the example of FIG. 2B will have a U cross-sectional shape with unrounded bottom corners, while the example of FIG. 2A will have a hollow rectangular cross-sectional shape with unrounded bottom corners.

Figure 2C:
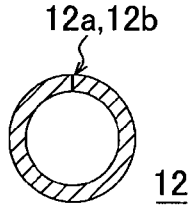

Further, the example of the elongated member 11 shown in FIG. 2C has a hollow circular cross-sectional shape with the left and right longitudinal edges 11*a* and 11*b* abutted against each other with no opening therebetween; namely, this example is of a hollow cross-sectional shape similarly to the example of FIG. 1D.

Figure 2D:
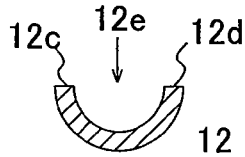

Furthermore, the example of the elongated member 11 shown in FIG. 2D has a semicircular cross-sectional shape with an opening portion 12*e* between left and right longitudinal edges 12*c* and 12*d* and a semicircular bottom portion with opposed left and right side wall portions partly removed. Here, the rectangular thin sheet metal plate in its initial (i.e., unbent) state has a stepped shape such that a portion of the thin sheet metal plate that will become the closed cross-sectional section (F-P) has a greater length or width, in the left-right direction, of the plate than that of a portion of the thin sheet metal plate that will become the open cross-sectional section (P-B).

Figure 3A:
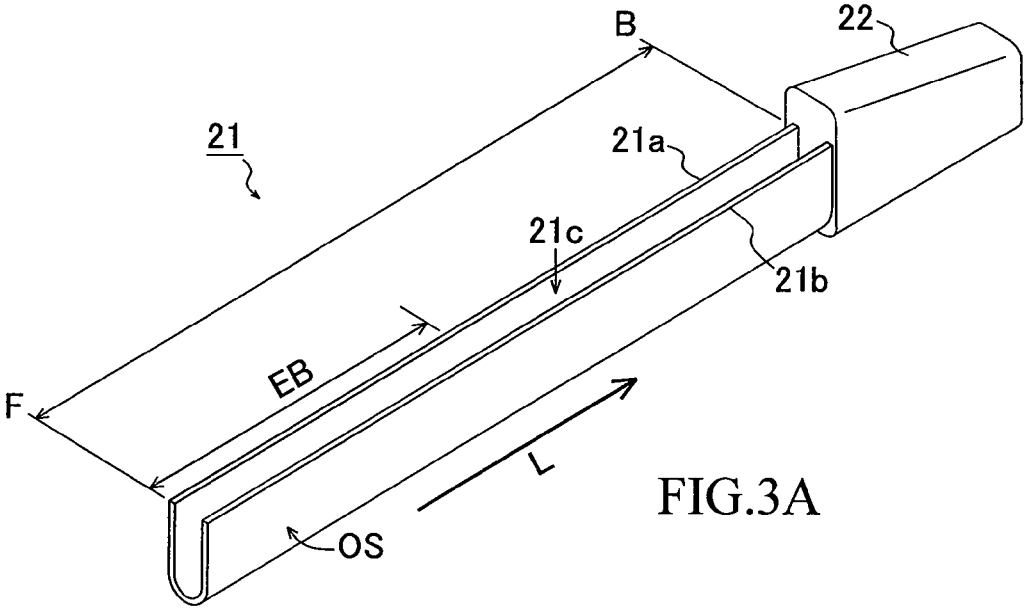
FIGS. 3A and 3B are fragmentary views showing a mass body unit employed in an electronic musical instrument keyboard apparatus according to a second embodiment of the present invention.
Figure 3B:
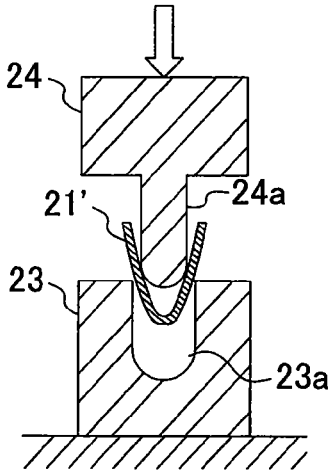

FIGS. 3A and 3B are views showing a mass body unit employed in a keyboard apparatus according to a second embodiment of the present invention. Although not specifically shown, the mass body unit in this embodiment may employ a base section that is of the same construction as the base section 3 employed in the first embodiment described above in relation to FIG. 1.

In the second embodiment, the elongated member 21 has an outer wall portion OS having an open cross-sectional section (F-B) along its full length, i.e. from the front end F to the rear end B.

As shown in FIG. 3A, a rectangular thin sheet metal plate is bent along its length so that the resultant elongated member 21 has a cross-sectional shape with an opening 21*c* formed between left and right longitudinal edges 21*a* and 21*b*; of course, these opening portion 21*c* and left and right longitudinal edges 21*a* and 21*b* extend over the full length of the elongated member 21. Thus, the elongated member 21 can provide a great moment of inertia of area in a direction toward the opening portion 21*c*, i.e. in the pivoting direction of the mass body unit.

In the illustrated example, the resultant elongated member 21 has a U cross-sectional shape similarly to the example shown in FIG. 1E. Alternatively, the elongated member 21 may have an open cross-sectional shape similar to those shown in FIGS. 2B and 2D.

The rear end B of the elongated member 21 is integrated with a mass concentrating section 22 of the mass body unit, while the front end F of the elongated member 21 is integrated with the base section 3 by outsert-molding or the like. Thus, even though the elongated member 21 has the open cross-sectional section (F-B) along its full length, the elongated member 21 can have a sufficient strength against undesired flexure in the left-right or width direction of the opening portion 2*c*, i.e. in the key-arranged direction.

To form the elongated member 21, as shown in FIG. 3B, a flat, thin sheet metal plate 21' is placed and then pressed between a lower mold 23 having an upwardly-oriented U-shaped concave portion 23*a* and an upper mold 23 having a U-shaped downward convex portion 24*a*, so that it is bent into the desired cross-sectional shape. Because the mandrel 5 shown in FIG. 1 is not required in this case, the bending work of the elongated member 21 can be facilitated even further.

Whereas the opening portion 21*c* of the cross-sectional section (F-B) opens upward (i.e., is oriented upward), the opening portion 21*c* may open downward.

Figure 4A:
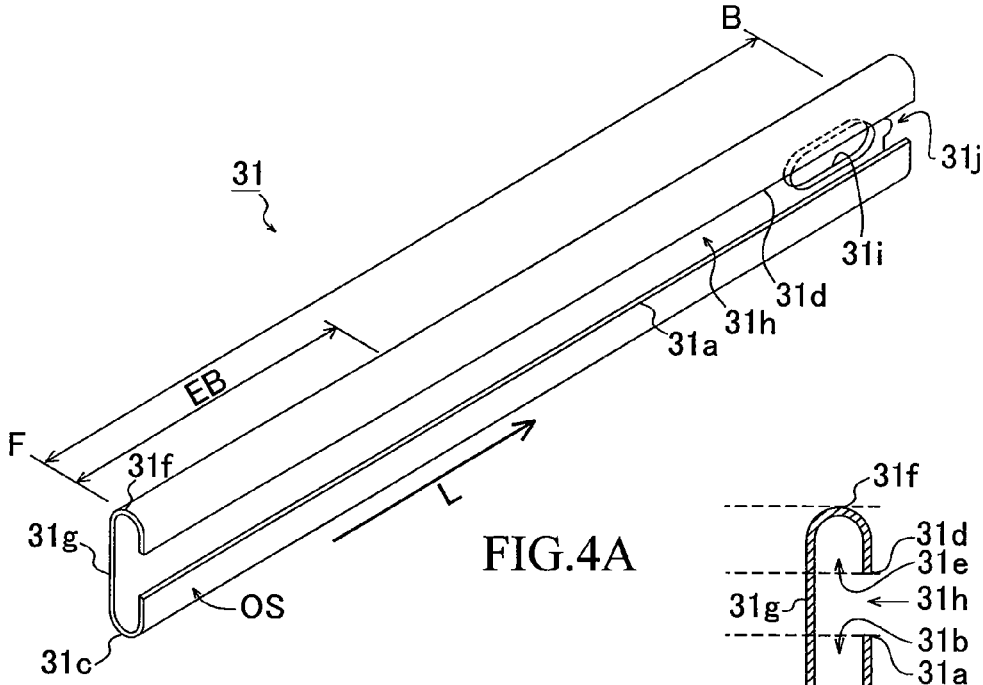
FIGS. 4A and 4B are fragmentary views showing a mass body unit employed in an electronic musical instrument keyboard apparatus according to a third embodiment of the present invention.
Figure 4B:
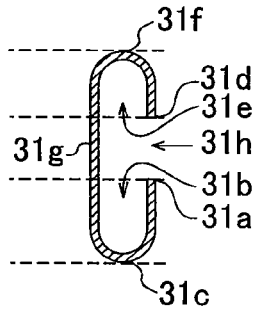

FIGS. 4A and 4B are views showing a mass body unit employed in a keyboard apparatus according to a third embodiment of the present invention. Although not specifically shown, the mass body unit in this embodiment employs a base section that is of the same construction as the base section 3 employed in the first embodiment described above in relation to FIG. 1. Mass concentrating section may be or may not be on the rear end B.

In FIG. 4A, reference numeral 31 indicates the elongated member 31, which has an open cross-sectional section (F-B) along its full length, and the outer wall portion OS of the elongated member 31 has first and second right longitudinal edges 31*a* and 31*d*, extending in the longitudinal direction of the elongated member 31, and an opening portion (hereinafter referred to as a third opening portion 31*h*) defined between the first and second right longitudinal edges 31*a* and 31*d* and extending in the longitudinal direction of the elongated member 31.

Whereas the elongated member 31 is shown in the figure as opening or oriented rightward, it may open leftward, in which case the outer wall portion of the elongated member 31 will have first and second left longitudinal edges in place of the first and second right longitudinal edges 31*a* and 31*d*.

FIG. 4B is a cross-sectional view of the elongated member 31, which includes first and second partial structures integrally joined with each other. The first partial structure includes a first bottom portion 31*c* of a semicircular cross-sectional shape and a first opening portion 31*b* oriented upwardly, while the second partial structure includes a second bottom portion 31*f* of a semicircular cross-sectional shape and a second opening portion 31*e* oriented downwardly. The integrally-joined first and second partial structures have a pair of vertically-opposed U sections. Respective left and right flat vertical surfaces of the first and second partial structures extend in parallel to each other in the longitudinal direction of the elongated member 31 with the first and second opening portions 31*b* and 31*e* located therebetween, and the first and second bottom portions 31*c* and 31*f* each have a semicircular cross section.

The respective opening portions 31*b* and 31*e* in these first and second partial structures are vertically opposed to each other, and, in the illustrated example, the respective left vertical side wall portions are integrally joined with each other via a vertical connecting side wall portion 31*g*.

The elongated member 21 employed in the embodiment described above in relation to FIG. 3 can be regarded as having only the first partial structure. By contrast, the elongated member 31 employed in the embodiment described above in relation to FIGS. 4A and 4B has not only the first partial structure but also the second partial structure and thus has an increased strength against undesired flexure.

In the illustrated example of FIGS. 4A and 4B, the first and second partial structures each have a U cross section similar to that shown in FIG. 1E. Alternatively, the first and second partial structures may each have a U cross section with rounded corners similarly to the elongated member 11 shown in FIG. 2B, or a semicircular cross section similarly to the elongated member 11 shown in FIG. 2D.

In the case where the first and second partial structures each have a U cross section, the respective left vertical side wall portions of the first and second partial structures are formed integrally with the vertical connecting side wall portion 31*g*, to provide a vertical flat surface integral and flush with that of the vertical connecting side wall portion 31*g*.

In the case where no mass concentrating section as shown in FIG. 1 is provided on the rear end B, parts of the first and second bottom portions 31*c* and 31*f* near the rear end B of the elongated member 31 function as abutting portions that strike the lower-limit and upper-limit stoppers (see 60 and 61 of FIG. 8). Because the first and second bottom portions 31*c* and 31*f* of the elongated member 31 each have a bottomed cross section having a semicircular or corner-rounded bottom portion such that the lower-limit and upper-limit stoppers can be less like to stay dented or break off due to aging than those of a projecting cross-sectional shape, the lower-limit and upper-limit stoppers (movement limiting members) can have an enhanced durability. As a consequence, the movement limiting members 60 and 61 can have enhanced durability.

Whereas the elongated member 31 shown in FIGS. 4*a* and 4B has been described above as having the open cross-sectional section (F-B) along its full length, it may have a closed cross-sectional section (F-P) over a region near the front end F as in the embodiment of FIG. 1.

In FIG. 4A, 31*i* indicates a through-hole, and 31*j* indicates a small projection. The through-hole 31*i* is formed in the left vertical side wall portions 31*g* of the first and second partial structures near the rear end B of the elongated member 31, and the projection 31*j* is formed on the front end B.

Although these elongated member 31*i* and projection 31*j* are not necessarily essential, they are preferably provided to adjust the mass of the elongated member 31 and appropriately position and fix the elongated member 31 at the time of the outsert-molding. Further, the projection 31*j* can be used for holding the elongated member 31 during transportation in a plating apparatus or automatic part transporting apparatus.

In a case where various variations of the elongated members 31 are employed in the keyboard apparatus as will be later described in relation to key touch scaling with reference to FIG. 8, manufacturing management, such as identification and selection, of such variations can be automatically performed if the positions and sizes of the through-hole 31*i* and projection 31*j* are varied among the variations.

Figure 5:
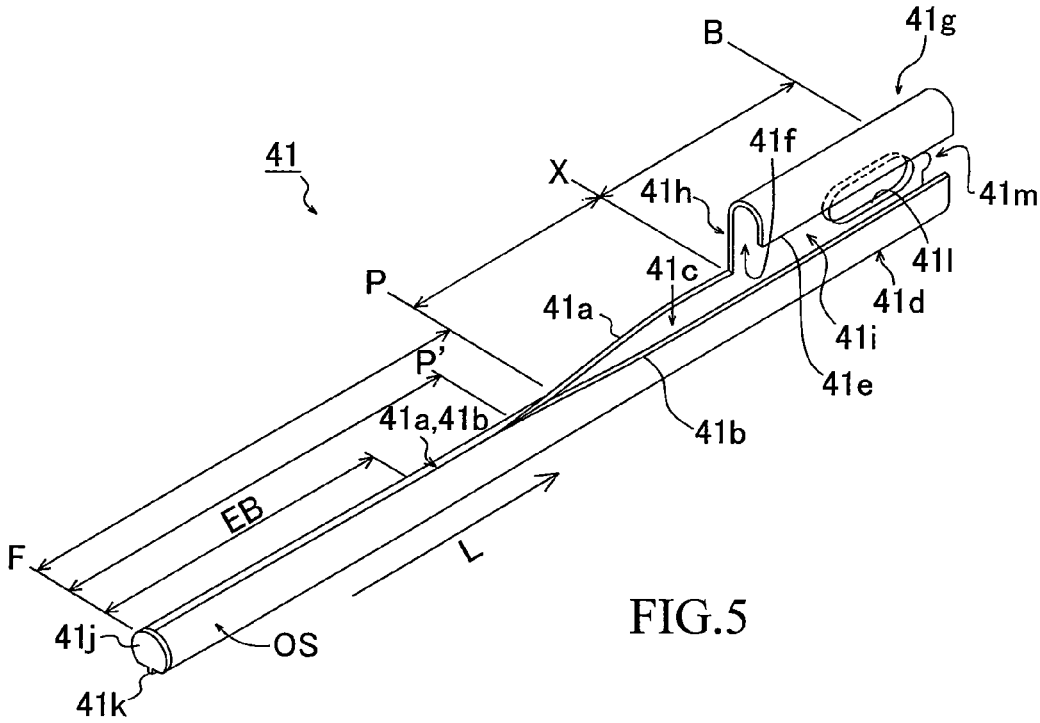
FIG. 5 is a fragmentary view showing a mass body unit employed in an electronic musical instrument keyboard apparatus according to a fourth embodiment of the present invention.

FIG. 5 is a view showing a mass body unit employed in a keyboard apparatus according to a fourth embodiment of the present invention. Although not specifically shown, the mass body unit in this embodiment may employ a base section that is of the same construction as the base section 3 employed in the first embodiment described above in relation to FIG. 1.

In the fourth embodiment, a left side wall portion of the elongated member 41 has a relatively great step at a longitudinal position X (hereinafter referred to as "stepped position X") thereof. Thus, the elongated member 41 has a closed cross-sectional section (F-P) from the front end F to the boundary position P, a first or front open cross-sectional section (P-X) from the boundary position P to the stepped position X, and a second or rear open cross-sectional section (X-B) from the stepped position X to the rear end B.

Combination of the closed cross-sectional section (F-P) and first open cross-sectional section (P-X) of the elongated member 41 corresponds to the elongated member 2 employed in the embodiment of FIG. 1. Namely, the elongated member 41 has, in the closed cross-sectional section (F-P), a cross-sectional shape (hollow circular cross-sectional shape) with an opening portion 41*c* between left and right longitudinal edges 41*a* and 41*b* closed (or partially closed as in the example of FIG. 1A).

The first open cross-sectional section (P-X) of the elongated member 41 is formed by a flat, thin sheet metal plate being bent along its longitudinal direction (along its length). Thus, the outer wall portion OS of the first open cross-sectional section (P-X) has a first structure of a U cross-sectional shape with a first bottom portion of a semicircular cross-sectional shape and opening portion 41*c* extending in the longitudinal direction between the left and right longitudinal edges 41*a* and 41*b*.

Further, the second open cross-sectional section (X-B) of the elongated member 41 is formed by the thin sheet metal plate being further bent, in addition to the bending to form the first open cross-sectional section (P-X) as noted above, along a length of a portion thereof that will become a left vertical side wall portion 41*h*, so that a second opening portion 41*f* is defined with a second right longitudinal edge 41*e*. Thus, the outer wall portion of the second open cross-sectional section (X-B) of the elongated member 41 has a cross-sectional shape, similar to that of the elongated member 31 of FIG. 4, with an opening portion (i.e., third opening portion 41*i*) extending in the longitudinal direction between the left and right longitudinal edges 41*a* and 41*b*.

Whereas the third opening portion 41*i* is shown as opening or oriented rightward, it may open leftward, in which case the second open cross-sectional section (X-B) has first and second left longitudinal edges in place of the first and second right longitudinal edges 41*a* and 41*e*.

The second open cross-sectional section (X-B) of the elongated member 41 preferably comprises a combination of two partial structures similarly to the elongated member 41 shown in FIG. 4B. Namely, the second open cross-sectional section (X-B) comprises a first partial structure having the above-mentioned first structure extending in the longitudinal direction, and a second partial structure including a semicircular bottom portion 41*g* (corresponding to the bottom portion 31*f* of FIG. 4B) and second opening portion 41*f* (corresponding to the opening portion 31*e* of FIG. 4B). The partial first and second structures are integrally joined with each other, in vertically opposed relation, via a vertical connecting side wall portion 41*h* (corresponding to the vertical connecting side wall portion 31*g* of FIG. 4B).

The first open cross-sectional section (P-X) of the elongated member 41 may have a semicircular cross-sectional shape shown and described above in relation to FIG. 2D, the closed cross-sectional section (F-P) of the elongated member 41 may have a corner-rounded bottom portion shown and described above in relation to FIG. 2A, and the first open cross-sectional section (F-P) of the elongated member 41 may have a corner-rounded bottom portion shown and described above in relation to FIG. 2A. Alternatively, the first open cross-sectional section (P-X) of the elongated member 41 may have a corner-rounded bottom portion shown and described above in relation to FIG. 2B.

In the second or rear open cross-sectional section (X-B) of the elongated member 41, at least parts of the first and second bottom portions 41*d* and 41*g* function as abutting portions that strike or abut against the lower-limit and upper-limit stoppers (movement limiting members) 60 and 61. Because the first and second bottom portions 41*d* and 41*g* of the elongated member 41 each have a semicircular or corner-rounded bottom portion, the lower-limit and upper-limit stoppers (movement limiting members) 60 and 61 can have an enhanced durability.

The second or rear open cross-sectional section (X-B) can function as a mass concentrating section because more mass concentrates on the section (X-B) than the closed cross-sectional section (F-P) and first open cross-sectional section (P-X). Thus, the mass concentrating section 4, normally provided as a separate component as shown in FIG. 1, may be replaced with a mass concentrating section formed of the same sheet metal plate as the elongated section 41; in this case, the rear end B is provided as the free end.

Because the moment of inertia is proportional to the square of a radius of rotation, the instant embodiment can increase the moment of inertia or inertia mass by constructing the second or rear cross-sectional section (X-B) to function as the mass concentrating section.

Whereas the illustrated example of FIG. 5 has the left vertical side wall portion 41*h*, it may have a right vertical side wall portion in place of the left vertical side wall portion 41*h*. Further, in the second or rear open cross-sectional section (X-B), the second right longitudinal edge 41*b* too may be raised in height, so that the left and right wall portions of that section (X-B) are located higher than the first or front open cross-sectional section (P-X). In this case, it is preferable that one of the side wall portions be bent while the other side wall portion be left unbent or flat, and that the longitudinal edge of the bent side wall portion and the longitudinal edge of the unbent side wall portion are opposed to each other or joined with each other via the third opening portion 41*i*.

Whereas, in the illustrated example of FIG. 5, the elongated member 41 has the closed cross-sectional section (F-P) as in the embodiment of FIG. 1, the elongated member 41 may have an open cross-sectional section, i.e. first and second open cross-sectional sections (F-X) and (X-B), over its full length.

In the illustrated example of FIG. 5 too, the elongated member 41 has a through-hole 41*l* and a small projection 41*m*. Namely, the through-hole 411 is formed near the rear end B in the vertical side wall portion of the second open cross-sectional section (mass concentrating section) (i.e., left vertical side wall portions of the first and second partial structures), and the small projection 41*m* is formed on the rear end B.

Although these through-hole 41*l* and small projection 41*m* are not necessarily essential, they can be used for similar purposes to the through-hole 31*i* and small projection 31*j* shown in FIG. 4A.

Figure 6:
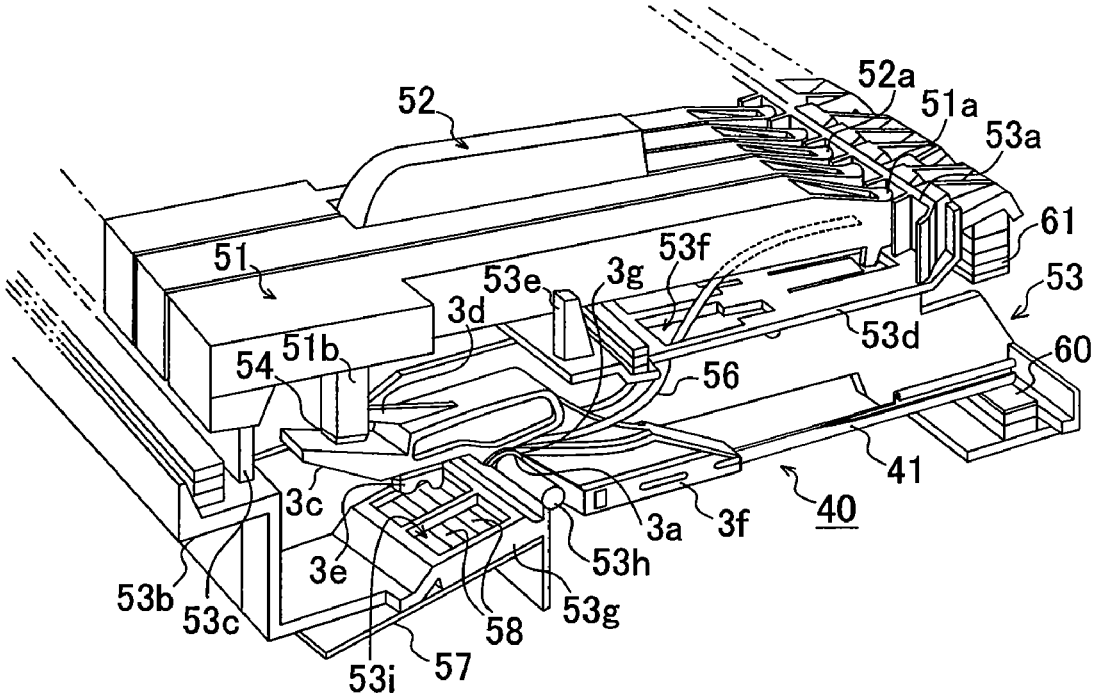
FIG. 6 is a perspective view showing a keyboard structure of an electronic musical instrument employing the mass body unit of FIG. 5.
Figure 7:
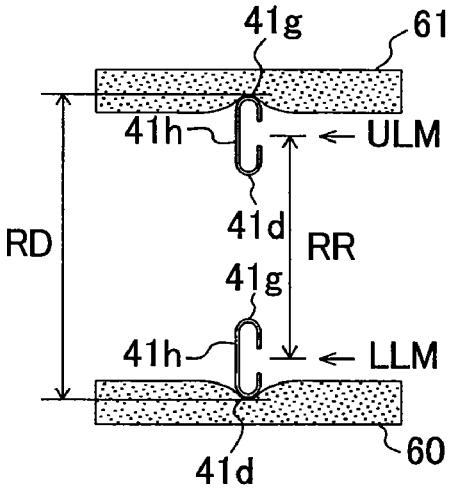
FIG. 7 is a view explanatory of behavior of the mass body unit in the keyboard structure of FIG. 6.

FIG. 6 is a perspective view showing the keyboard apparatus or structure of the electronic musical instrument employing the mass body unit 40 shown in FIG. 5. In FIG. 6, the same elements as in FIGS. 8 and 5 are indicated by the same reference numerals and characters as in the figures and will not be described here to avoid unnecessary duplication. Further, FIG. 6 is a schematic view explanatory of the mass body unit 40 in the keyboard apparatus.

When the mass concentrating section of the mass body unit 40 is in its lower limit position LLM, the first bottom portion 41*d* of the elongated member 41 rests on the lower-limit stopper 60 while slightly depressing the stopper 60. When the mass concentrating section of the mass body unit 40 is in its upper limit position ULM, on the other hand, the second bottom portion 41*g* of the elongated member 41 rests on the upper-limit stopper 61 while slightly depressing the stopper 61.

Difference or distance between the position of the first bottom portion 41*d* of the elongated member 41 when the mass concentrating section of the mass body unit 40 is in its lower limit position LLM and the position of the second bottom portion 41*g* of the elongated member 41 when the mass concentrating section of the mass body unit 40 is in its upper limit position is a reference distance RD between the lower-limit and upper-limit stoppers 60 and 61. Such a reference distance is determined by the constructions of the frame 53 and lower-limit and upper-limit stoppers 60 and 61.

Pivotable range (pivotable stroke) RR of the mass body unit 40 corresponds to a distance between the center of the mass concentrating section in the lower limit position LLM and the center of the mass concentrating section in the upper limit position ULM.

Therefore, the pivotable range of the mass body unit 40 can be appropriately adjusted by merely changing the height of the vertical side wall portion 41*h* of the second or rear open cross-sectional section (X-B), and thus, the pivotable range of the mass body unit 40 can be adjusted to suit the reference distance RD between the lower-limit and upper-limit stoppers 60 and 61.

Further, there have heretofore been known the key touch scaling technique where the moment of inertia of the mass body unit is varied among tone pitches or key ranges (tone pitch ranges or registers). For example, the mass of the mass body unit may be decreased as the pitch increases, so that a key of a lower tone pitch can be performed with a heavier key touch and a key of a higher tone pitch can be played with a lighter key touch.

In each of the embodiments of FIGS. 1 and 3, the mass of the mass concentrating section 3 or 22 is varied. In the embodiment of FIG. 5, on the other hand, the stepped position X may be varied to change the longitudinal length of the second open cross-sectional section (X-B) so that the mass of inertia of the mass body unit 40 takes a value corresponding to the pitch or key range assigned to the key corresponding to the mass body unit 40. Because the mass of inertia of the elongated member 41 too varies in response to the positional variation in the stepped position X, it is possible to readily vary the key touch in accordance with the pitch or key range of the corresponding key.

Typically, the unbent (or planar developed) shape of the bendable, thin sheet metal plate may be designed such that the stepped position X is located more rearward, in the longitudinal direction of the elongated member, for a key of a higher tone pitch or for a higher key range.

Further, the mass of inertia of the mass body unit 40 may be made to take a value corresponding to the pitch or key range assigned to the key corresponding to the mass body unit 40, by changing the length from the front end F to the rear end B (i.e., longitudinal length of the elongated member 41). For example, the length from the front end F to the rear end B may be decreased, with the length of the second open cross-sectional section (X-B) (or the length of the mass concentrating section) as the tone pitch or key range assigned to the corresponding key becomes higher. This scheme may also be applied to the embodiment shown and described above in relation to FIG. 4.

In the case where the length of the elongated member 31 itself is varied in the keyboard apparatus shown in FIG. 6, however, there would arise the problems that the pivotable range of the mass member undesirably varies and the positions at which the elongated member 31 abuts against the lower-limit and upper-limit stoppers 60 and 61 would undesirably shift toward the back of the keyboard.

In an alternative, the lengths of the elongated member and mass concentrating section may be varied at the same time.

Further, the through-hole 31*i* and small projection 31*j* shown and described above in relation to FIG. 4 and the through-hole 41*l* and small projection 41*m* shown and described above in relation to FIG. 5 may be used not only for the mere mass adjustment but also for the key touch scaling.

Referring back to FIG. 5, the size and/or position of at least one of the through-hole 41*l* and small projection 41*m* is varied in accordance with the tone pitch or key range of the key corresponding to the mass body unit having the elongated member 41, so that the mass of inertia of the mass body unit 40 may be made to take a value corresponding to the pitch or key range assigned to the key corresponding to the mass body unit 40. This variation of the size and/or position may be employed in combination with variation of at least one of the length of the second open cross-sectional section (X-B) of the elongated member 41 and the length from the front end F to the rear end B.

This application is based on, and claims priority to, JP PA 2007-140369 filed on 28 May 2007. The disclosure of the priority applications, in its entirety, including the drawings, claims, and the specification thereof, is incorporated herein by reference.

What is claimed is:

1. An electronic musical instrument keyboard apparatus comprising:

a plurality of keys;

a plurality of mass body units each pivotable in response to operation of a corresponding one of the keys;

a frame supporting said plurality of keys and said plurality of mass body units; and a movement limiting member provided on said frame for limiting a pivotable range of each of said keys, wherein each of said mass body units includes an elongated member, said elongated member being formed, by a bendable sheet metal plate being bent along a longitudinal direction thereof, to have a cross section with an opening portion.

2. The electronic musical instrument keyboard apparatus as claimed in claim 1 wherein said elongated member has, in a longitudinal section thereof, a cross section with the opening portion closed.

3. The electronic musical instrument keyboard apparatus as claimed in claim 2 wherein said elongated member has, in a section thereof having the cross section with the opening portion, first and second partial structures each having a cross section with a bottom portion and the opening portion, said first and second partial structures being joined with each other via a single vertical side wall portion with respective ones of the opening portions vertically opposed to each other.

4. The electronic musical instrument keyboard apparatus as claimed in claim 2 wherein said elongated member has, in a first section thereof that is a part of a section having the cross section with the opening portion, a first structure including a bottom portion and the opening portion with the opening portion oriented upward or downward, and wherein said elongated member has, in a second section thereof that is another part of the section having the cross section with the opening portion, a first partial structure that is a longitudinal extension of said first structure and a second partial structure that has a cross section with a bottom portion and the opening portion, the first and second partial structures being joined with each other via a single vertical side wall portion with respective ones of the opening portions vertically opposed to each other.

5. The electronic musical instrument keyboard apparatus as claimed in claim 4 wherein at least one of a length, in the longitudinal direction, of said second section of said elongated member and a length, in the longitudinal direction, of said elongated member is varied in accordance with a tone pitch or key range of a key corresponding to the mass body unit having said elongated member so that a mass of inertia of said elongated member takes a value corresponding to the tone pitch or key range of the key corresponding to the mass body unit.

6. The electronic musical instrument keyboard apparatus as claimed in claim 1 wherein said elongated member has, in a section thereof having the cross section with the opening portion, first and second partial structures each having a cross section with a bottom portion and the opening portion, said first and second partial structures being joined with each other via a single vertical side wall portion with respective ones of the opening portions vertically opposed to each other.

7. The electronic musical instrument keyboard apparatus as claimed in claim 1 wherein said elongated member has, in a first section thereof that is a part of a section having the cross section with the opening portion, a first structure including a bottom portion and the opening portion with the opening portion oriented upward or downward, and wherein said elongated member has, in a second section thereof that is another part of the section having the cross section with the opening portion, a first partial structure that is a longitudinal extension of said first structure and a second partial structure that has a cross section with a bottom portion and the opening portion, the first and second partial structures being joined with each other via a single vertical side wall portion with respective ones of the opening portions vertically opposed to each other.

8. The electronic musical instrument keyboard apparatus as claimed in claim 7 wherein at least one of a length, in the longitudinal direction, of said second section of said elongated member and a length, in the longitudinal direction, of said elongated member is varied in accordance with a tone pitch or key range of a key corresponding to the mass body unit having said elongated member so that a mass of inertia of said elongated member takes a value corresponding to the tone pitch or key range of the key corresponding to the mass body unit.

9. The electronic musical instrument keyboard apparatus as claimed in claim 1 which further includes a resin-made base section, and wherein a part of said elongated member is embedded in said base section.

10. The electronic musical instrument keyboard apparatus as claimed in claim 9 wherein the part of said elongated member embedded in said base section has a closed cross section with no opening.

11. The electronic musical instrument keyboard apparatus as claimed in claim 10 wherein at least a portion of a non-embedded part of said elongated member, integrally formed with the part embedded in said base section, has a closed cross section with no opening.

12. The electronic musical instrument keyboard apparatus as claimed in claim 11 wherein the opening portion of said elongated member has a section where the opening gradually decreases from a greatest-width region toward a region having the cross section with no opening.

13. The electronic musical instrument keyboard apparatus as claimed in claim 10 wherein the opening portion of said elongated member has a section where the opening gradually decreases from a greatest-width region toward a region having the cross section with no opening.

14. An electronic musical instrument keyboard apparatus comprising:

a plurality of keys:

a plurality of mass body units each pivotable about a pivot point portion in response to operation of a corresponding one of the keys;

a frame supporting said plurality of keys and said plurality of mass body units; and a movement limiting member provided on said frame for limiting a pivotable range of each of said keys, wherein each of said mass body units includes an elongated member, said elongated member having an outer wall portion of a cross section defining a hollow interior portion, said elongated member having an elongated uniform-cross-sectional section where the cross section is uniform in the longitudinal direction, said elongated member having, in a region thereof adjacent to a free end of said elongated member and remote from the pivot point portion, an opening greater than an opening formed in the uniform-cross-sectional section.

* * * * *